US010507686B2

(12) United States Patent
Bitannie

(10) Patent No.: US 10,507,686 B2
(45) Date of Patent: Dec. 17, 2019

(54) BEAT RECORDING PEN

(71) Applicant: Morgan Bitannie, Avondale, AZ (US)

(72) Inventor: Morgan Bitannie, Avondale, AZ (US)

( * ) Notice: Subject to any disclaimer, the term of this patent is extended or adjusted under 35 U.S.C. 154(b) by 0 days.

(21) Appl. No.: 16/109,227

(22) Filed: Aug. 22, 2018

(65) Prior Publication Data

US 2019/0061412 A1 Feb. 28, 2019

Related U.S. Application Data

(60) Provisional application No. 62/551,940, filed on Aug. 30, 2017.

(51) Int. Cl.

*B43K 29/00* (2006.01)
*G10D 13/00* (2006.01)
*G10H 1/00* (2006.01)

(52) U.S. Cl.

CPC ..... *B43K 29/004* (2013.01); *B43K 29/005* (2013.01); *G10D 13/003* (2013.01); *G10H 1/0083* (2013.01); *G10H 2220/185* (2013.01); *G10H 2230/275* (2013.01); *G10H 2240/211* (2013.01); *G10H 2240/285* (2013.01)

(58) Field of Classification Search

CPC .... B43K 29/004; B43K 29/005; B43K 29/00; B43K 29/002; B43K 29/007; B43K 29/10; B43K 29/18; G10H 1/0083; G10H 2220/185; G10H 2230/275; G10H 2250/211; G10H 2240/285; G10H 1/00; G10H 1/0033; G10H 2220/191; G10D 13/003; G10D 13/00

See application file for complete search history.

(56) References Cited

U.S. PATENT DOCUMENTS

| | | | | |
|---|---|---|---|---|
| 4,332,496 | A * | 6/1982 | Branch | G10D 3/16 401/195 |
| 4,995,294 | A | 2/1991 | Kashio et al. | |
| 5,247,131 | A | 9/1993 | Okamoto et al. | |
| 6,604,880 | B1 * | 8/2003 | Huang | B43K 29/004 362/118 |
| 7,261,484 | B2 * | 8/2007 | Gallagher | B26D 1/045 340/571 |
| 7,314,325 | B2 * | 1/2008 | Chang | B43K 29/005 362/118 |
| 8,118,510 | B1 * | 2/2012 | Kamhi | B43K 29/005 340/692 |
| 2005/0271458 | A1 | 12/2005 | Kui | |
| 2009/0019986 | A1 | 1/2009 | Simpkins | |
| 2011/0239847 | A1 | 10/2011 | Small et al. | |

* cited by examiner

*Primary Examiner* — David J Walczak
(74) *Attorney, Agent, or Firm* — Global Intellectual Property Agency, LLC; Daniel Boudwin

(57) ABSTRACT

A beat recording pen for the recording and editing music and while serving as writing instrument. The device includes a retractable writing instrument disposed in an elongated shaft designed to house a power supply designed to provide electrical power to a transceiver that can transmit and receive digital signals to and from a connected mobile device or computer. The beat recording pen further includes an impact sensor that can detect an audio input signal of an impact event and convert the audio input signal into a digital signal. A micro-controller is disposed within the pen and can record the converted audio input signals detected by the impact sensor and interface with a software application installed on a connected mobile device or computer.

10 Claims, 7 Drawing Sheets

BEAT RECORDING PEN

CROSS REFERENCE TO RELATED APPLICATIONS

This application claims the benefit of U.S. Provisional Application No. 62/551,940 filed on Aug. 30, 2017. The above identified patent application is herein incorporated by reference in its entirety to provide continuity of disclosure.

BACKGROUND OF THE INVENTION

The present invention relates to music editing. More specifically, the present invention provides a dual-purpose writing instrument, and music editing device.

Often, when writing, drawing, or otherwise working with a pen, it is common for individuals play with the pen by tapping it on a nearby surface to create a melody. In some instances this seemingly mindless action can produce worthwhile music that the in creator may wish to save and replay. Currently, there is not an easy way to capture this music and save it. Therefore, a pen that can record beats and transmit the recording to a mobile device is needed.

The present invention provides a means for capturing the music created in these moments, as well as a means of transferring the music over to a mobile device or computer for further editing, rearrangement, and more permanent storage.

In light of the devices disclosed in the known art, it is submitted that the present invention substantially diverges in design elements from the known art and consequently it is clear that there is a need in the art for an improvement to existing electronic communication monitoring devices. In this regard the instant invention substantially fulfills these needs.

SUMMARY OF THE INVENTION

In view of the foregoing disadvantages inherent in the known types of dual-purpose writing instruments, and music editing devices now present in the prior art, the present invention provides a dual-purpose writing instrument, and music editing device wherein the same can be utilized for providing convenience for the user when using a pen to tap on a surface to create music.

It is therefore an object of the present invention to provide a new and improved in-game communication monitoring system that has all of the advantages of the known art and none of the disadvantages.

Another object of the present invention is to provide an elongated shaft including a retractable writing instrument, a compartmentalized interior volume configured to house a power supply, a transceiver, an impact sensor, and a micro-controller.

Yet another object of the present invention is to provide a retractable writing instrument disposed in a first end of the elongated shaft.

A further object of the present invention is to provide an impact sensor configured to detect an audio input signal of an impact event, such as the tapping of the first end against a surface, and to convert the audio input signal into a digital signal.

Another object of the present invention is to provide a transceiver configured to transmit digital signals to and receive digital signals from a connected mobile device or computer.

Yet another object of the present invention is to provide a micro-controller configured to record the converted audio input signals detected by the impact sensor, and to interface with a connected mobile device or computer via a software application.

An additional object of the present invention is to provide a power supply operably connected to the micro-controller, the impact sensor and the transceiver, such that the micro-controller, the impact sensor and the transceiver are supplied with electrical power.

Still another object of the present invention is to provide a software application installed on the mobile device or computer configured to interface with the micro-controller to further manipulate the converted audio input signal, and to record the converted audio input signal in a non-transitory medium.

A further object of the present invention is to provide an elongated shaft is shaped in the form of a drumstick, such that the first end is in the form of a drumstick head.

Another object of the present invention is to provide an electronic port disposed on a second end of the elongated shaft is configured to receive and establish an electronic connection with another electronic device.

Yet another object of the present invention is to provide a first button configured to extend and retract the writing instrument disposed within the first end of the elongated shaft such that the beat recording pen can be used as a writing device.

A further object of the present invention is to provide a second button configured to initiate the recording of impact events like the tapping sound of the pen on a surface, via the micro-controller.

Another object of the present invention is to provide a third button configured to activate wireless transmission of the digital signals recorded on the microcontroller via the transceiver.

Yet another object of the present invention is to provide a fourth button configured to playback and to manipulate the converted audio input signal via software application on the connected mobile device or computer.

An additional object of the present invention is to provide a rechargeable power supply.

Still another object of the present invention is to provide an electronic port in the form of a USB port.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
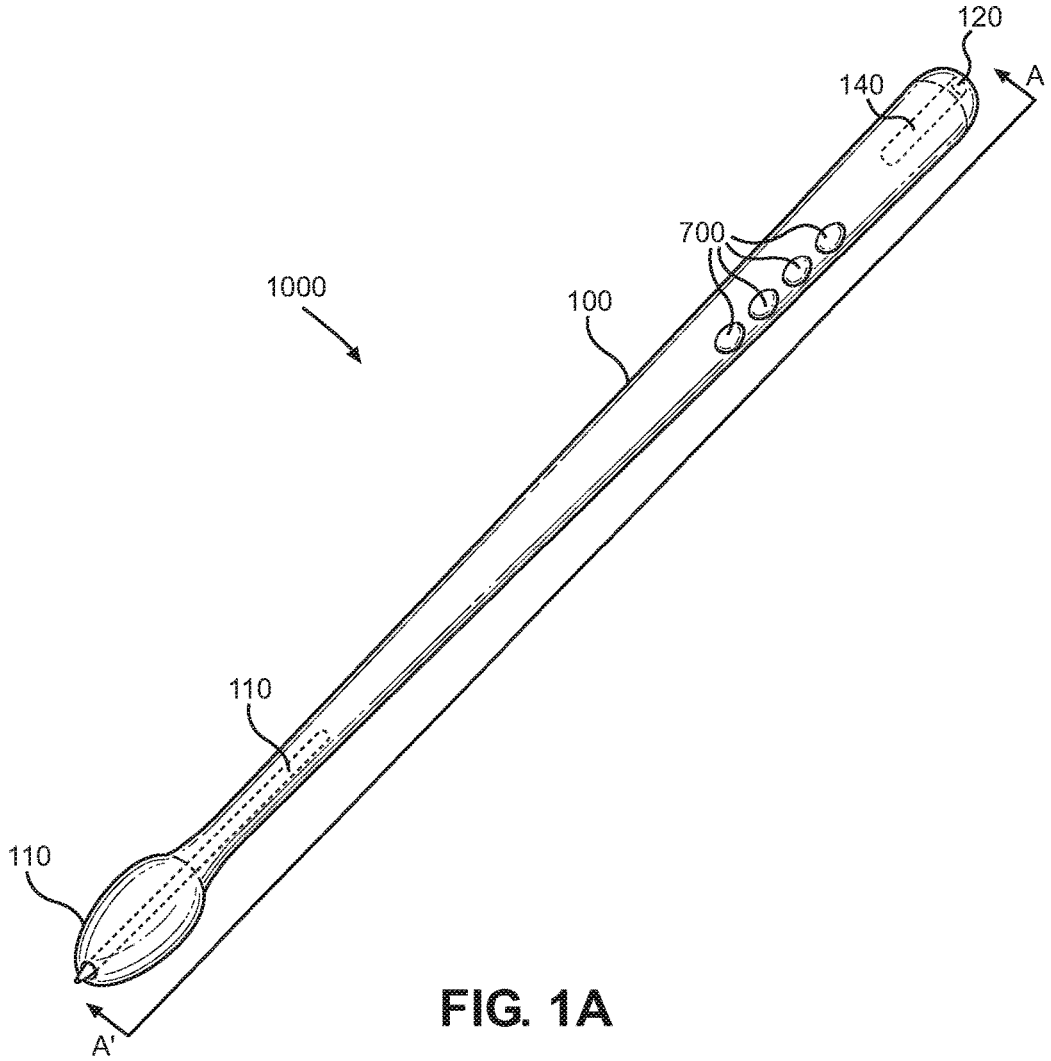
FIG. 1A shows a perspective view of an embodiment of the beat recording pen, where the retractable writing instrument is in the extended position.

Reference is made herein to the attached drawings. Like reference numerals are used throughout the drawings to depict like or similar elements of the beat recording pen. The figures are intended for representative purposes only and should not be considered to be limiting in any respect.

Figure 1B:
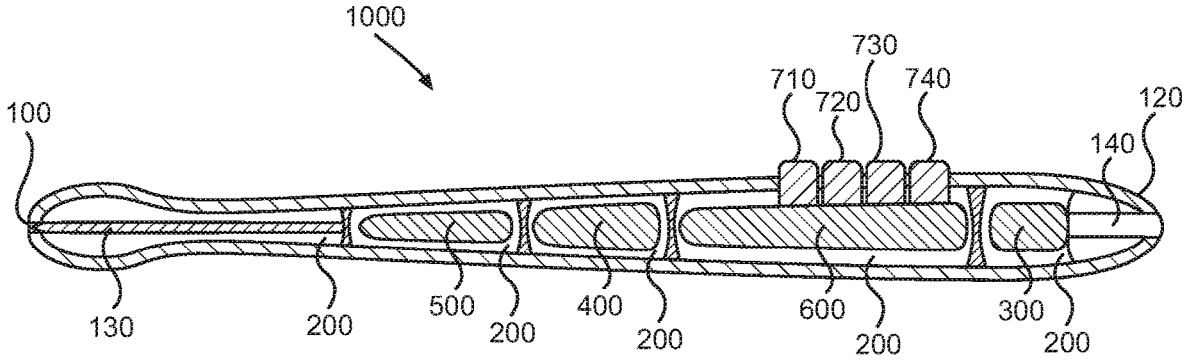
FIG. 1B shows a cross-sectional view along line AA' of an embodiment of the beat recording pen, where the retractable writing instrument is in the retracted position.

Referring now to FIGS. 1A and 1B, there are shown a perspective view of an embodiment of the beat recording pen, where the retractable writing instrument is in the extended position, and a cross-sectional view along line AA' of an embodiment of the beat recording pen, where the retractable writing instrument is in the retracted position, respectively. In the illustrated embodiment, the beat recording pen 1000 includes a retractable writing instrument 130 disposed in a first end 110 of an elongated shaft 100. The elongated shaft 100 further includes a compartmentalized interior volume 200 configured to house a power supply 300 operably connected to a transceiver 400, an impact sensor 500, and a micro-controller 600 such that the micro-controller 600, the impact sensor 500 and the transceiver 400 are supplied with electrical power. In some embodiments the power supply 300 is rechargeable to increase efficiency and convenience for the user. In the illustrated embodiment, each compartment is separated from one another via a dividing wall.

In the illustrated embodiment, the operation of the micro-controller 600 is in operable connection with a plurality of buttons 700 disposed on the outer wall of the elongated shaft. The buttons 700 are configured to provide commands to the micro-controller 600 in order to perform operations of retracting the writing instrument, recording audio signals detected from the impact sensor, and sending the recording to a software application installed on a connected mobile device or computer, among other operations.

In the illustrated embodiment, the first end 110 comprises an oval shaped cross section, such that a middle section of the first end 110 includes a diameter that tapers outwards. The shape of the first end 110 provides more weight thereto and allows a user to more effectively tap a surface using the first end 110 of the beat recording pen 1000. In the illustrated embodiment, the weight of the first end 110 is greater than the weight of an opposing second end 120.

Figure 2A:
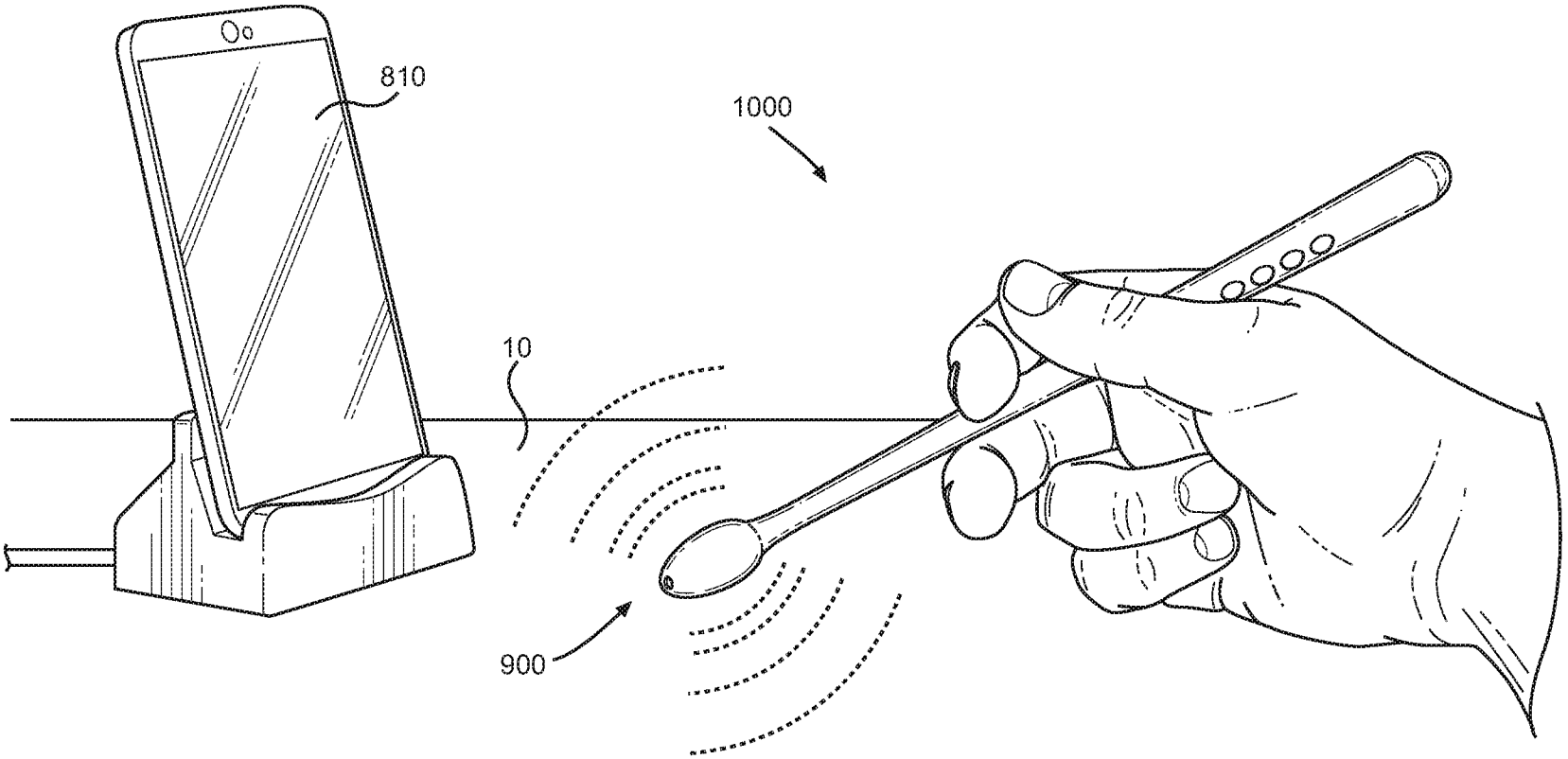
FIG. 2A shows a perspective view of an embodiment of the beat recording pen, in use tapping on a surface.
Figure 2B:
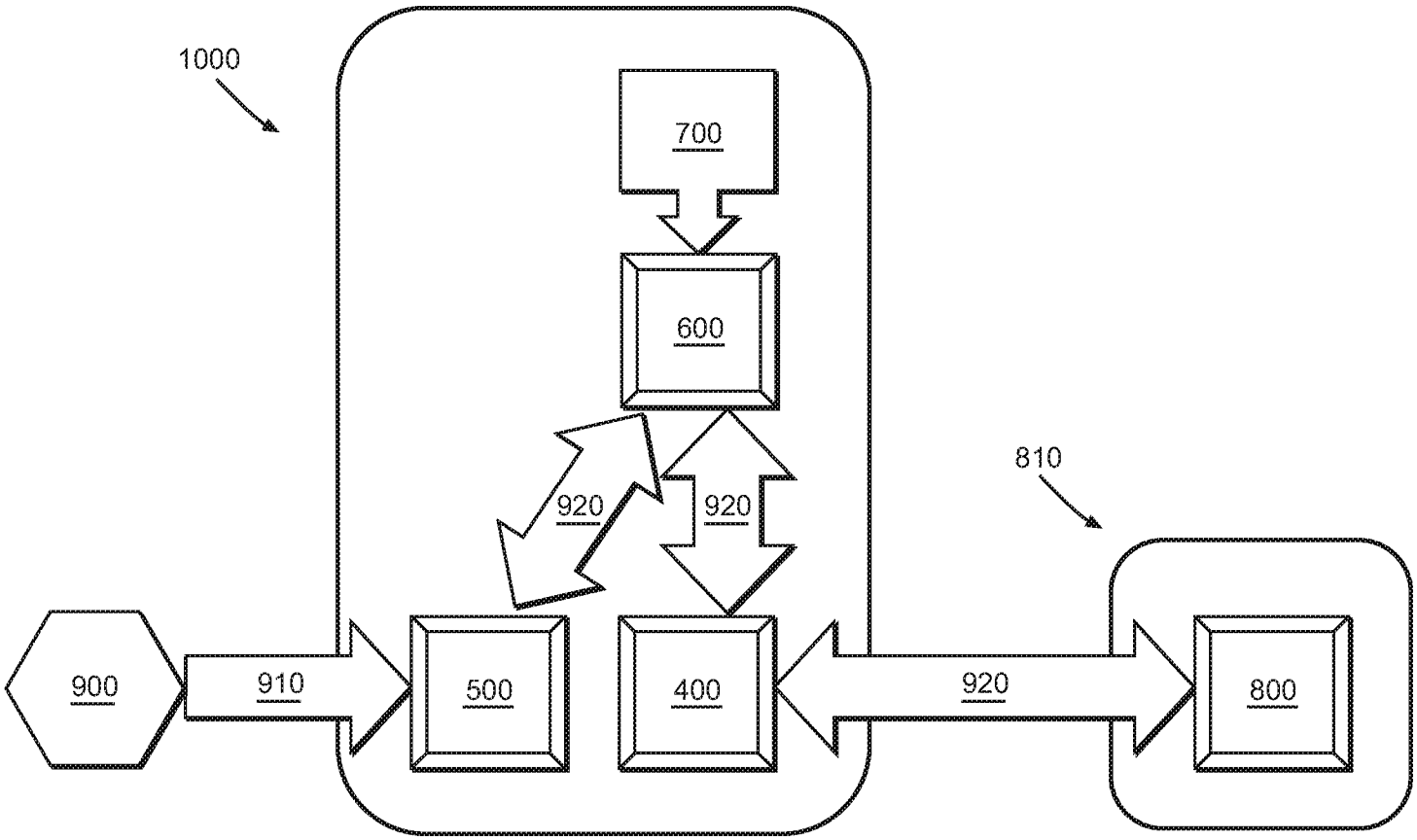
FIG. 2B shows a logical view of how an impact event is processed by an embodiment of the beat recording pen and an accompanying mobile device.

Referring now to FIGS. 2A and 2B, there are shown a perspective view of an embodiment of the beat recording pen, in use tapping on a surface, and a logical view of how an impact event is processed by an embodiment of a beat recording pen and an accompanying mobile device, respectively. In the illustrated embodiment the impact sensor 500 is configured to detect an audio input signal 910 of an impact event 900, such as the tapping of the first end 110 against a surface 10, to convert the audio input signal 910 into a digital signal 920, and to send the converted digital signal 920 on to the micro-controller 600. Additionally, the transceiver 400 is configured to transmit digital signals 920 to and to receive digital signals 920 from a connected mobile device 810 or computer, and to send these digital signals 920 on to the micro-controller 600. The micro-controller 600 is configured to record the digital signals 920 converted from the audio input signals 910 detected by the impact sensor 500, and to send and receive digital signals 920 to a connected mobile device 810 or computer via a software application 800. Furthermore, in this embodiment the operation of the micro-controller 600 is partially controlled by the plurality of buttons 700 disposed on the outer wall of the elongated shaft.

Figure 3A:
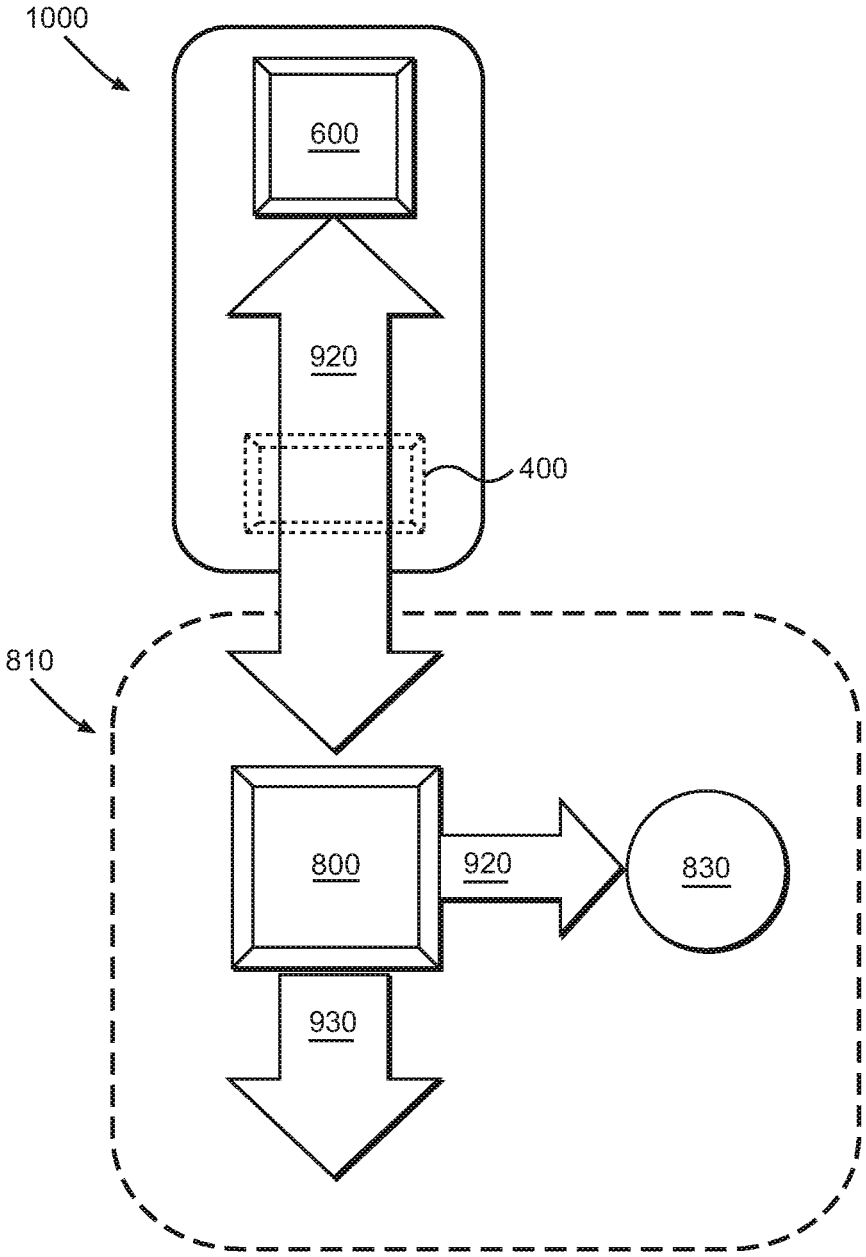
FIG. 3A shows a logical view of how a software application is used to interface with a microcontroller on an embodiment of the beat recording pen.
Figure 3B:
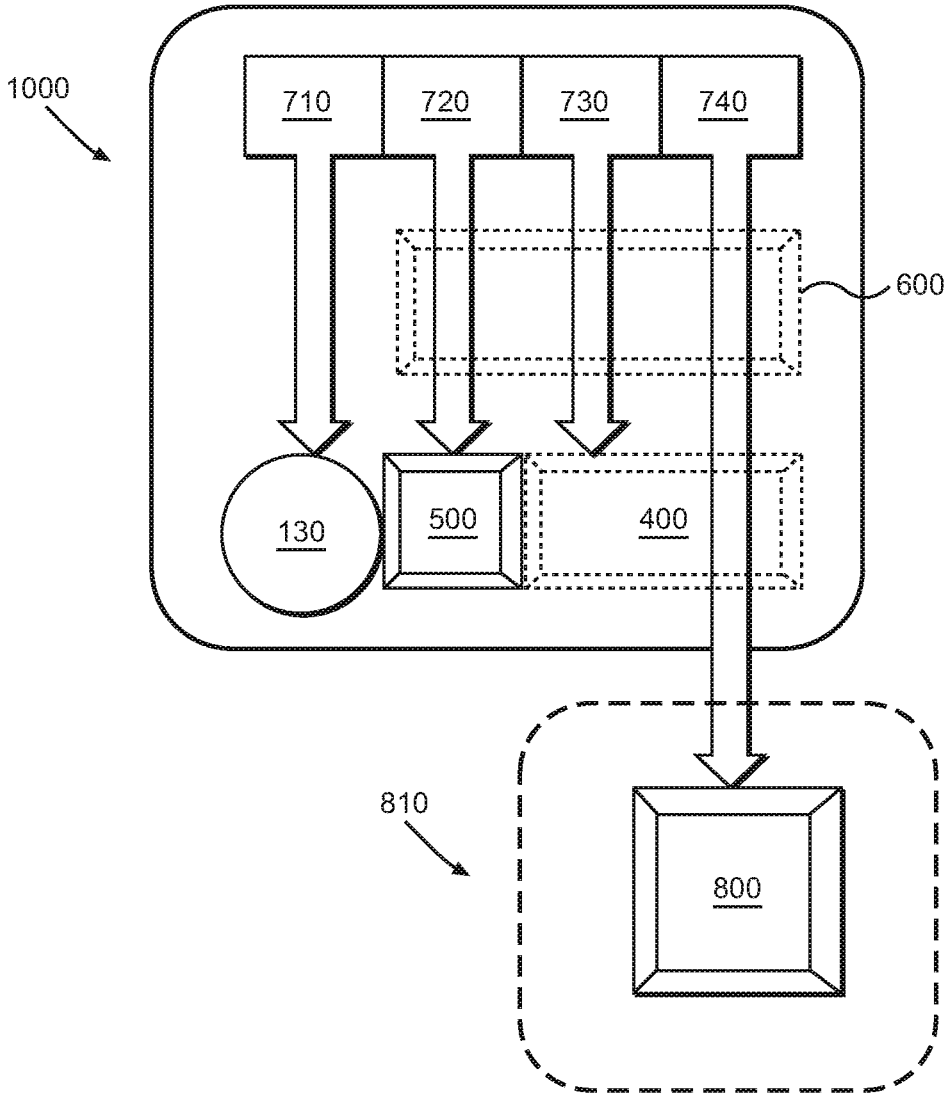
FIG. 3B shows a logical view of the operative functions of a plurality of buttons on an embodiment of the beat recording pen.
Figure 3C:
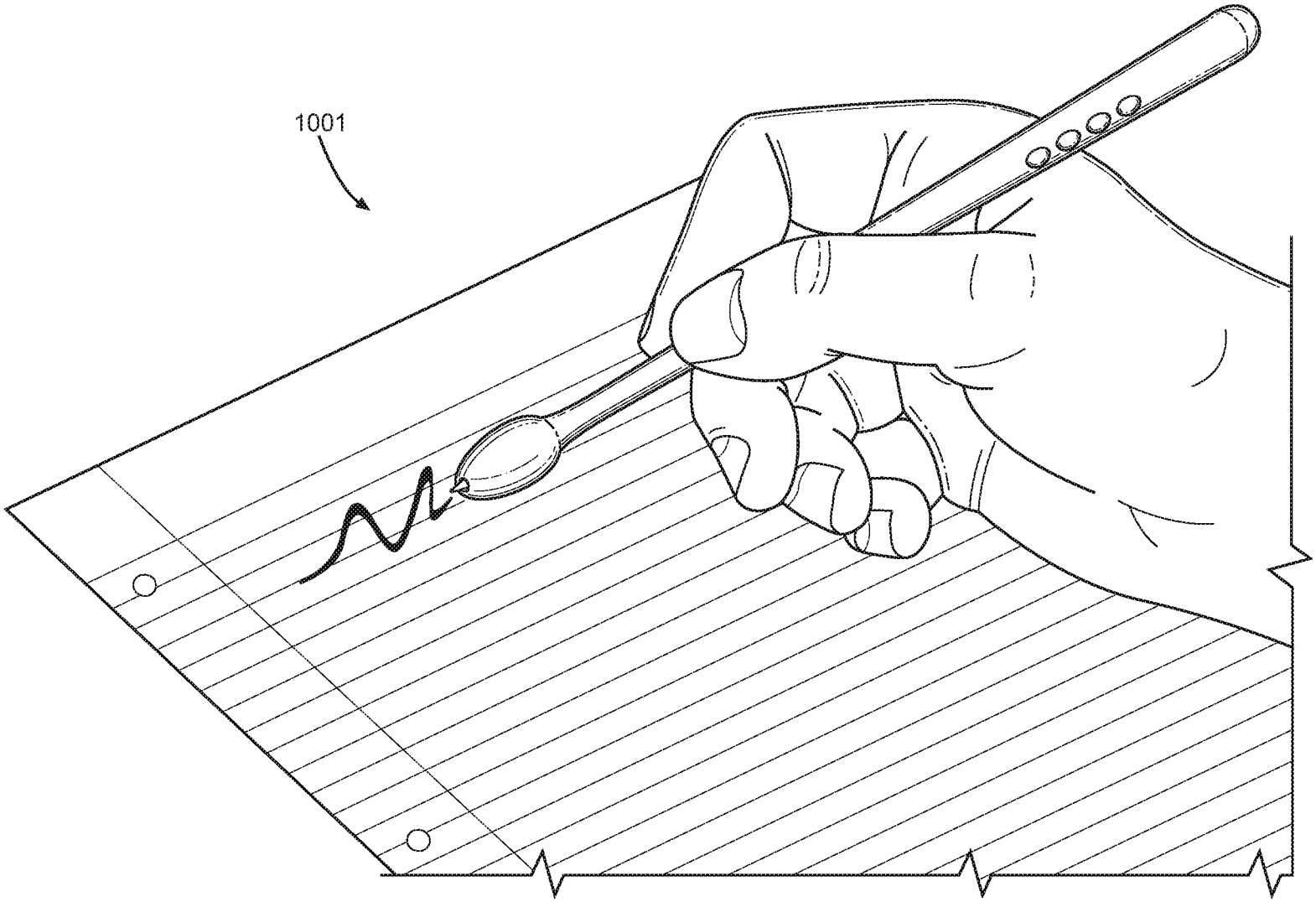
FIG. 3C shows a perspective view of an embodiment of the beat recording pen, in use as a writing device.

Referring now to FIGS. 3A, 3B, and 3C, there is shown a logical view of how a software application is used to interface with a microcontroller on an embodiment of the beat recording pen, a logical view of the operative functions of a plurality of buttons on an embodiment of the beat recording pen, and a perspective view of an embodiment of the beat recording pen, in use as a writing device, respectively. In the illustrated embodiment the software application 800 installed on the mobile device 810 or computer is configured to interface with the micro-controller 600 by sending digital signals 920 back and forth via the transceiver 400 of the beat recording pen 1000. Additionally, the software application 800 is also configured to further manipulate the converted audio input signal 910 to output enhanced or augmented audio files 930 that are modified versions of the original audio input signal 910. In some embodiments the manipulation carried out by the software application 800 can increase or decrease the pitch and tempo of the recorded beat, or overlay the original audio input signal 900 onto itself or onto a separate and unrelated audio file to create the enhanced or augmented file 930. The software application is also configured to record the converted audio input signal 910 in a non-transitory medium 830 like a web-server online for permanent storage.

In some embodiments a first button 710 is configured to extend and retract the writing instrument 130 disposed within the first end 110 of the elongated shaft 100 such that the beat recording pen 1000 can be used as a writing device 1001 as shown in FIG. 3C. This extension and retraction can be accomplished mechanically or electronically through the micro-controller 600, here the feature is mechanical. A second button 720, third button 730, and fourth button 740 are all configured to perform electronic functions through the micro-controller 600. The second button 720 is configured to initiate the recording of impact events 900 like the tapping sound of the pen on a surface, via the micro-controller 600, the third button 730 is configured to activate wireless transmission of the digital signals 920 recorded on the microcontroller 600 via the transceiver 400, and the fourth button 740 is configured to manipulate the converted audio input signal 910 via software application 800 on the connected mobile device 810 or computer 820.

Figure 4A:
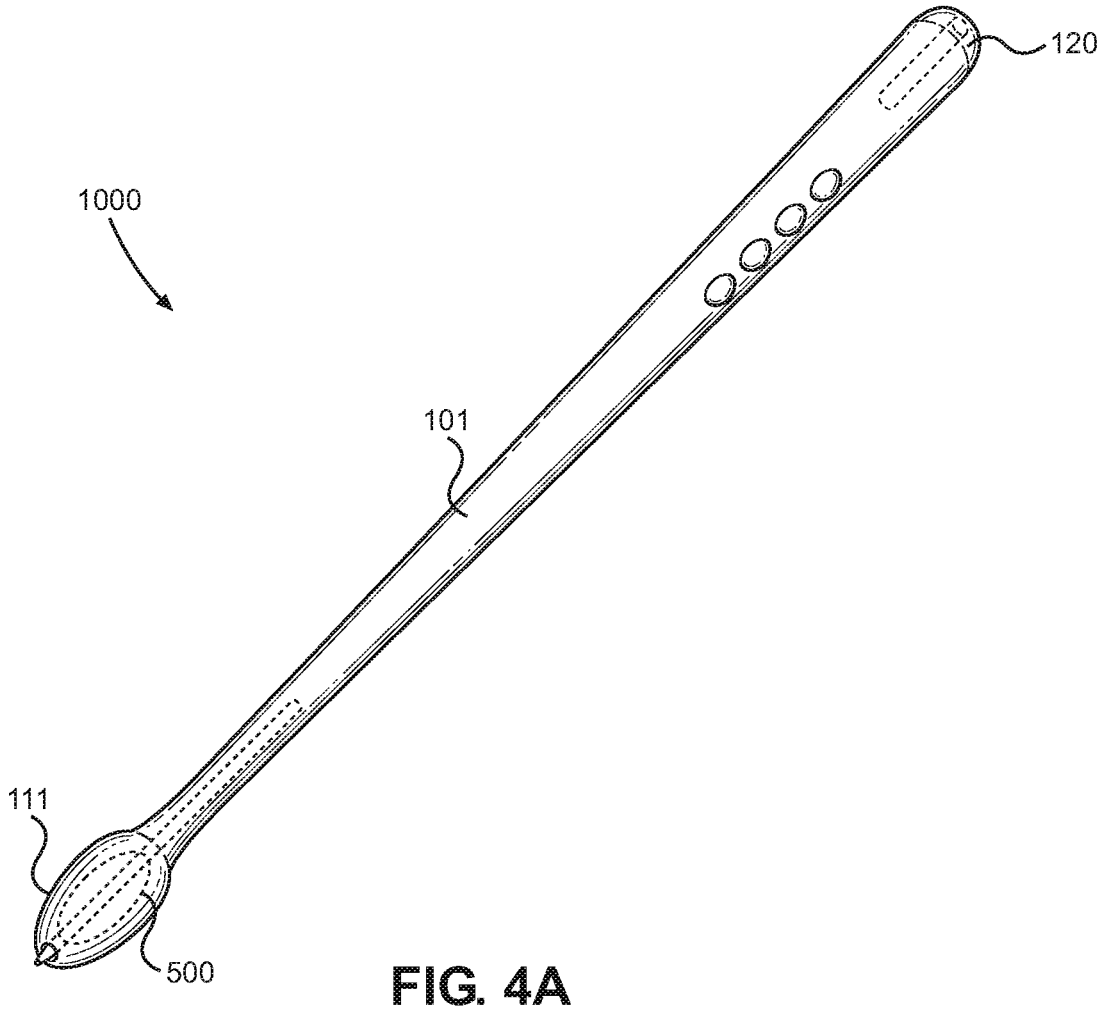
FIG. 4A shows a perspective view of an embodiment of the beat recording pen, in in the form of a drumstick.
Figure 4B:
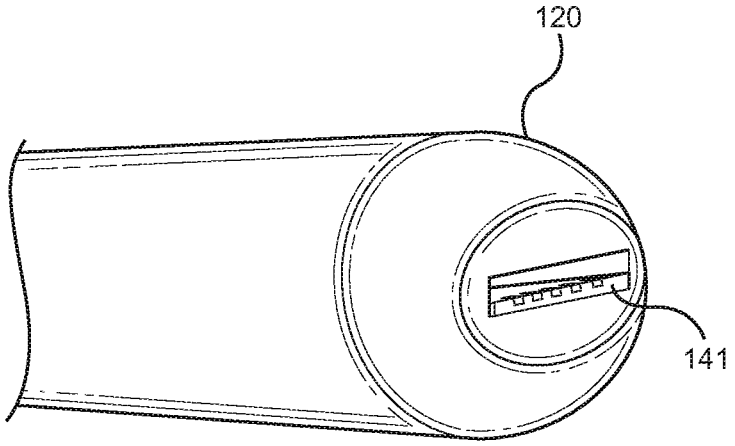
FIG. 4B shows a close-up view of a USB port disposed in a second end of an embodiment of the beat recording pen.

Referring now to FIGS. 4A and 4B, there is shown a perspective view of an embodiment of a beat recording pen in in the form of a drumstick, and a close-up view of the USB port disposed in a second end of an embodiment of the beat recording pen, respectively. In the illustrated embodiment the elongated shaft 100 is shaped in the form of a drumstick 101, such that the first end 110 is in the form of a drumstick head 111. Furthermore, an electronic port 140 is disposed on the second end 120 of the elongated shaft 100 and configured to receive and establish an electronic connection with another electronic device 850. In some embodiments the electronic port 140 is a USB port 141 as shown in FIG. 4B. The electronic port allows a user to retrieve stored digital signals 920 recorded on the microcontroller 600, as opposed to sending via the transceiver 400.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beat recording pen comprising:

a retractable writing instrument disposed in a first end of an elongated shaft;

the elongated shaft further including a compartmentalized interior volume comprising a power supply, a transceiver, an impact sensor, and a micro-controllerl;

wherein the impact sensor is configured to detect an audio input signal of an impact event, such as the tapping of the first end against a surface, and to convert the audio input signal into a digital signal;

wherein the transceiver is configured to transmit digital signals to and receive digital signals from a connected mobile device or computer, wherein the micro-controller is configured to record the converted audio input signals detected by the impact sensor, and to interface with a connected mobile device or computer via a software application;

wherein the power supply is operably connected to the micro-controller, the impact sensor and the transceiver, such that the micro-controller, the impact sensor and the transceiver are supplied with electrical power;

a plurality of buttons disposed on the outer wall of the elongated shaft.

2. The beat recording pen of claim 1, wherein the elongated shaft is shaped in the form of a drumstick, such that the first end is in the form of a drumstick head.

3. The beat recording pen of claim 1, wherein an electronic port disposed on a second end of the elongated shaft is configured to receive and establish an electronic connection with another electronic device.

4. The beat recording pen of claim 3, wherein the electronic port is a USB port.

5. The beat recording pen of claim 1, wherein the power supply is rechargeable.

6. The beat recording pen of claim 1, wherein a first button of the plurality of buttons is configured to extend and retract the writing instrument disposed within the first end of the elongated shaft such that the beat recording pen can be used as a writing device.

7. The beat recording pen of claim 6, wherein a second button of the plurality of buttons is configured to initiate the recording of impact events like the tapping sound of the pen on a surface, via the micro-controller.

8. The beat recording pen of claim 6, wherein a third button of the plurality of buttons is configured to activate wireless transmission of the digital signals recorded on the microcontroller via the transceiver.

9. The beat recording pen of claim 1, wherein a fourth button of the plurality of buttons is configured to playback and to manipulate the converted audio input signal via software application on the connected mobile device or computer.

10. The beat recording pen of claim 1, wherein the software application installed on the mobile device or computer is configured to interface with the micro-controller to further manipulate the converted audio input signal, and to record the converted audio input signal in a non-transitory medium.

* * * * *